US006150804A

United States Patent [19]

Taghizadeh-Kaschani

[11] Patent Number: 6,150,804

[45] Date of Patent: Nov. 21, 2000

[54] VOLTAGE REGULATOR

[75] Inventor: Karim-Thomas Taghizadeh-Kaschani, Unterhaching, Germany

[73] Assignee: Infineon Technologies AG, Munich, Germany

[21] Appl. No.: 09/495,713

[22] Filed: Feb. 1, 2000

[30] Foreign Application Priority Data

Feb. 3, 1999 [DE] Germany ..... 199 04 344

[51] Int. Cl.[7] ..... G05F 1/40

[52] U.S. Cl. ..... 323/285; 323/282

[58] Field of Search ..... 323/222, 271, 323/273, 275, 280, 282, 285, 286

[56] References Cited

U.S. PATENT DOCUMENTS

| | | | |
|---|---|---|---|
| 4,823,070 | 4/1989 | Nelson | 323/285 |
| 5,220,272 | 6/1993 | Nelson | 323/282 |
| 5,867,048 | 2/1999 | Chou | 327/173 |
| 5,894,243 | 4/1999 | Hwang | 323/242 |

OTHER PUBLICATIONS

Tietze, Schenk; "Halbleiterschaltungstechnik", 10 Auflage, Springer–Verlag, Aug. 1993, pp. 542–555.

Teitze, Schnek; "Halbleiterschaltungstechnik", 10 Auflage, Springer–Verlag, Aug. 1993, pp. 563–571.

*Primary Examiner*—Matthew Nguyen

*Attorney, Agent, or Firm*—Schiff Hardin & Waite

[57] ABSTRACT

A voltage regulator system is disclosed that has its input connected to a first supply voltage and has its output voltage at an output supplied during normal operation via a feedback line to an input of an integrated circuit with a drive for monitoring and regulating the output voltage to a predetermined, first voltage value with the drive, whereby a circuit arrangement for detecting an interruption of the feedback line is provided, and whereby, when an interruption occurs, a switch is made at the output from the predetermined, first voltage value to a predetermined, second voltage value.

14 Claims, 5 Drawing Sheets

VOLTAGE REGULATOR

BACKGROUND OF THE INVENTION

1. Field of the Invention

The invention is directed to a voltage regulator whose input is connected to a first supply voltage and whose output voltage at an output is supplied in normal operation via a feedback line to an input of an integrated circuit having a circuit block for driving the actuator in order to assure the monitoring and regulating of the output voltage to a predetermined first voltage value.

2. Description of the Related Art

For both clocked as well as linear voltage regulators, it is necessary that the regulated output voltage is constantly monitored by a regulator in order to immediately provide correction when a deviation from a rated value is detected. This allows the output voltage to be kept constant. Linear voltage regulators are known, for example, from Tietze, Schenk, Halbleiterschaltungstechnik, 10th Edition, Springer-Verlag, 1993, pages 542 through 555. Clocked voltage regulators, for example, in the form of an up or of a down converter, are described on pages 563 through 571 in the same reference.

For a clocked voltage regulator, when the output voltage drops below a predetermined value, the duty cycle of the switch is increased by a drive so that the output voltage again approaches the predetermined rated value. Generating a constant output voltage at a predetermined rated value is thus based on a constantly operating control circuit. One problem arises for this device when the line with which the voltage regulator monitors the output voltage is interrupted. As a rule, the input node of the drive circuit is internally connected to ground through some resistance so that the voltage at the input node drops to zero in the case of a line interruption. The voltage regulator must then assume that its output voltage is too low and thus attempts to increase the output voltage above the rated value without taking potentially connected users into consideration. This leads to damage to the connected users if additional, external protective measures at the users end are not provided.

SUMMARY OF THE INVENTION

The object of the present invention is therefore comprised in providing a voltage regulator of the type cited above that recognizes a condition deviating from the normal operation, particularly an interruption of the feedback line from the output to a drive, and that dependably protects users connected to the output of the voltage regulator against malfunction or destruction.

Inventively, a circuit arrangement for detecting an interruption of the feedback line is provided in the voltage regulator, in which a switch is made to a predetermined, second voltage value from a predetermined, first voltage value at the output of the voltage regulator if an interruption of the feedback line occurs. Advantageously, the output of the voltage regulator is connected to a ground-related charge storage that can store a first charge quantity in a first time span, in which the voltage dropping off at the charge storage is supplied to the drive and to the circuit arrangement for detecting an interruption of the feedback line during normal operation. The circuit arrangement for detecting an interruption of the feedback line is advantageously connected to the drive with its output. What is achieved by this is that, given an interruption of the feedback line, the drive-up of the voltage at the output of the voltage regulator can be prevented so that a malfunction or destruction of the connected users cannot occur. The circuit arrangement for detecting an interruption of the feedback line can thus be used in a linear as well as in clocked voltage regulator.

Advantageous developments of the invention are discussed below.

The circuit arrangement for detecting an interruption of a predetermined, first voltage value in the inventive voltage regulator is such that, in case of an interruption at the input of the circuit arrangement, a second, lower, predetermined voltage value than the voltage dropping off at the charge storage is provided within a second time span, which is provided together with a reference voltage value generated within a third time span from the occurrence of the interruption to a respective input of an evaluator that generates a signal at the output of the circuit arrangement that is supplied to the drive.

The advantage of the inventive circuit arrangement is in that the actual function of the feedback line, namely to supply the voltage adjacent at the output to a drive that keeps the output voltage at a constant predetermined first voltage value, is not negatively influenced.

For generating the second voltage value, a series circuit composed of a current source, of a switch mechanism and of a resistor is advantageously provided between supply potential terminals, whereby the junction between the resistor and the switch mechanism, on the one hand, is interconnected to the input of the circuit arrangement and, on the other hand, to the first input of the evaluator. For generating the reference voltage value, a series circuit of a second source, of a second switch mechanism and of a charge storage is advantageously provided between the supply potential terminals, whereby the junction between the second charge storage and the second switch mechanism is interconnected to the second input of the evaluator, and whereby at least one semiconductor switch has its load path connected parallel to the charge storage.

By impressing a defined, internal current into the input node of the circuit arrangement and by comparing the resulting voltage drop-off at the resistor to the voltage that arises due to the impressing of a reference current via the second charge storage, a determination can be made as to whether there is an interruption or not in the feedback line. The first and the second charge storage are dimensioned such that, during normal operation, the voltage at the input of the circuit arrangement rises clearly more slowly then the voltage via the second charge storage. Given an interruption of the feedback line, it is not the first charge storage that determines the voltage at the input of the circuit arrangement but the voltage immediately dropping off via the resistor, which is significantly lower than the rated voltage dropping off at the first charge storage.

The evaluator of the circuit arrangement for detecting an interruption of a predetermined, first voltage value in the inventive voltage regulator is such that it comprises a first and a second differential amplifier whose positive inputs are connected to one another and to the input of the circuit arrangement and form the first input of the evaluator. The negative input of the first differential amplifier is connected to a means switchable between two voltage values. The negative input of the second differential amplifier is connected to the junction between the second charge storage and the second switch mechanism. The output of the first differential amplifier, on the one hand, drives the first and the second switch mechanism conductive in the case of error, inhibits, on the other hand, the second semiconductor switch connected parallel to the second charge storage in case of error and continues to be connected to a first input of a logic element. The output of the second differential amplifier is connected to a second input of the logic element, and the output of the logic element is connected to the output of the circuit arrangement for detecting an interruption of a predetermined, first voltage level. Given the occurrence of a fault, the output of the logic element inhibits the second switch mechanism. The second switch mechanism advantageously comprises two semiconductor switches serially interconnected with their load path. The logic element is advantageously an AND gate, whereby the first input is implemented inverting. The first and the second charge storage are advantageously capacitors, whereby the storage capability of the first charge storage is far, far greater then the storage capability of the second charge storage. Advantageously, a voltage source is to be connected between the negative input of the second differential amplifier and the second charge storage.

The circuit arrangement in the inventive voltage regulator comprises the advantageous property that a fault of the feedback line can be distinguished from a run-up of the voltage regulator. What is thereby to be understood by a run-up of the voltage regulator is that a voltage differing from zero is applied to the input of the voltage regulator for the first time, so that the voltage regulator attempts to achieve the predetermined rated value voltage at the output. An undefined change of the status output is thus suppressed, i.e. it can be unambiguously identified whether a fault is present or not.

Otherwise, the status output of the circuit arrangement exhibits a signal that indicates the correct functioning of the voltage regulator to the drive or, on the other hand, via a signal mechanism as well. Due to the specific embodiment of the circuit arrangement, what is also achieved is that this exhibits only a slight power consumption during normal operation, since the current sources are turned off due to the specific functioning of the evaluator. These, consequently, only generate current that is felt is a voltage drop off at the resistor or, respectively, the second charge storage when the circuit arrangement checks whether a fault could be present. Further, a monolithic integration of the circuit arrangement for detecting an interruption of a predetermined, first voltage value together with the drive is possible.

BRIEF DESCRIPTION OF THE DRAWINGS

The invention is explained in greater detail below on the basis of the following Figures.

Shown are.

DESCRIPTION OF THE PREFERRED EMBODIMENTS

Figure 1:
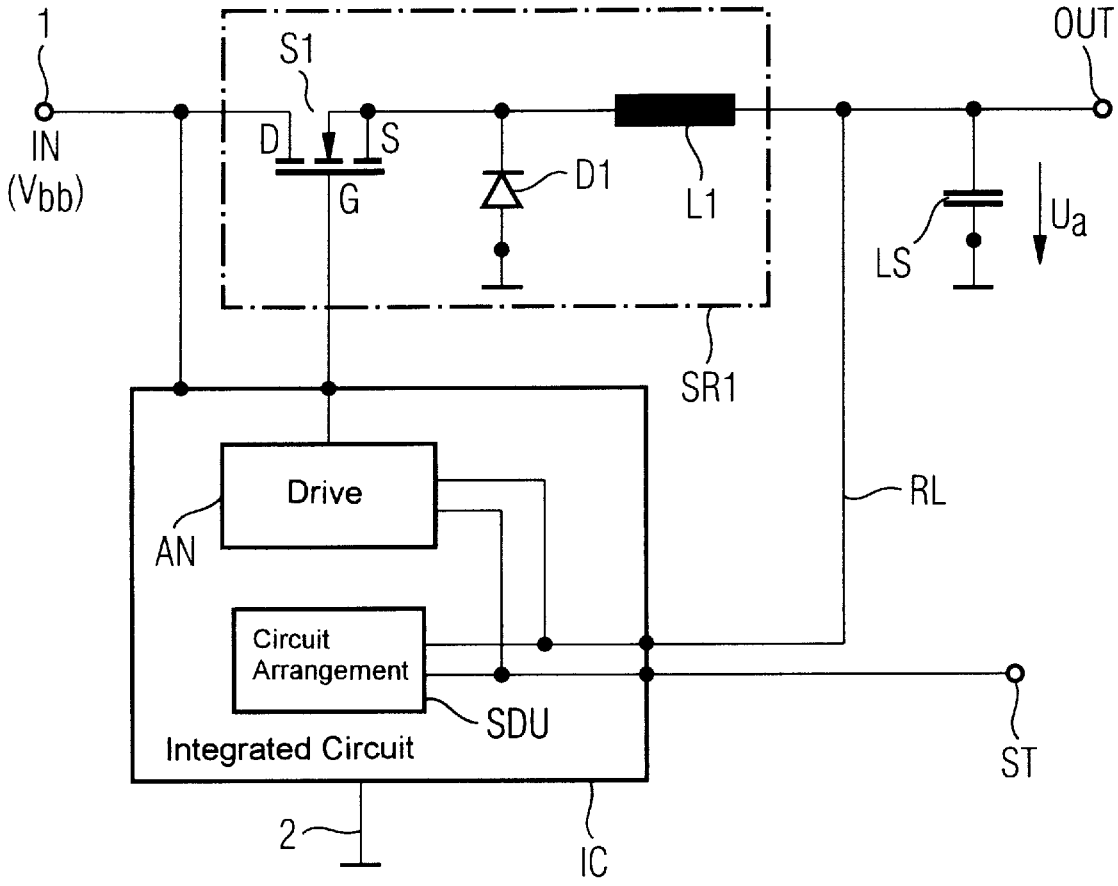
FIG. 1 an inventive, clocked voltage regulator in the form of a down converter.

FIG. 1 shows the fundamental structure of an inventive, clocked voltage regulator, in which the voltage regulator SRI is implemented in the form of a down converter. The voltage regulator is supplied with a usually positive supply voltage Vbb at its input IN, which simultaneously represents a first supply potential terminal 1. The voltage regulator SRI contains a semiconductor switch S1 that, can be implemented as MOSFET or other possible switch circuits. The semiconductor switch S1 has its drain connected to the input IN, and its source terminal S is connected to the cathode terminal of a diode D1 connected to a reference potential. The reference potential GND simultaneously represents a second supply potential terminal 2.

Furthermore, a terminal of an inductor L1 is connected to the source terminal S of the semiconductor switch S1. The other terminal of inductor L1 is tied to the output OUT and is connected to a charge storage LS that is connected to reference potential.

The charge storage LS is implemented as capacitor that exhibits a capacitance C1. In order to obtain a regulated voltage at the output OUT, the voltage regulator comprises a feedback line RL that is connected at one end to the output OUT and at the other end to the input $IN_1$ of an integrated circuit IC.

The integrated circuit IC comprises a drive AN that, depending on the output voltage $U_a$, controls the clock frequency of the gate G of the semiconductor switch S1. The integrated circuit is also connected to the input IN as well as to the reference potential GND. The integrated circuit IC further comprises a circuit arrangement SDU for detecting an interruption of the feedback line RL.

The circuit arrangement SDU is likewise connected via the input $IN_1$ to the feedback line RL. It further comprises an output ST that is connected to the drive AN in order to be able to shut the voltage regulator off if a fault occurs. The output ST of the circuit arrangement SDU is also conducted out of the integrated circuit IC.

The clocked voltage regulator SRI could also be implemented as an up converter or as a linear voltage regulator.

Figure 2:
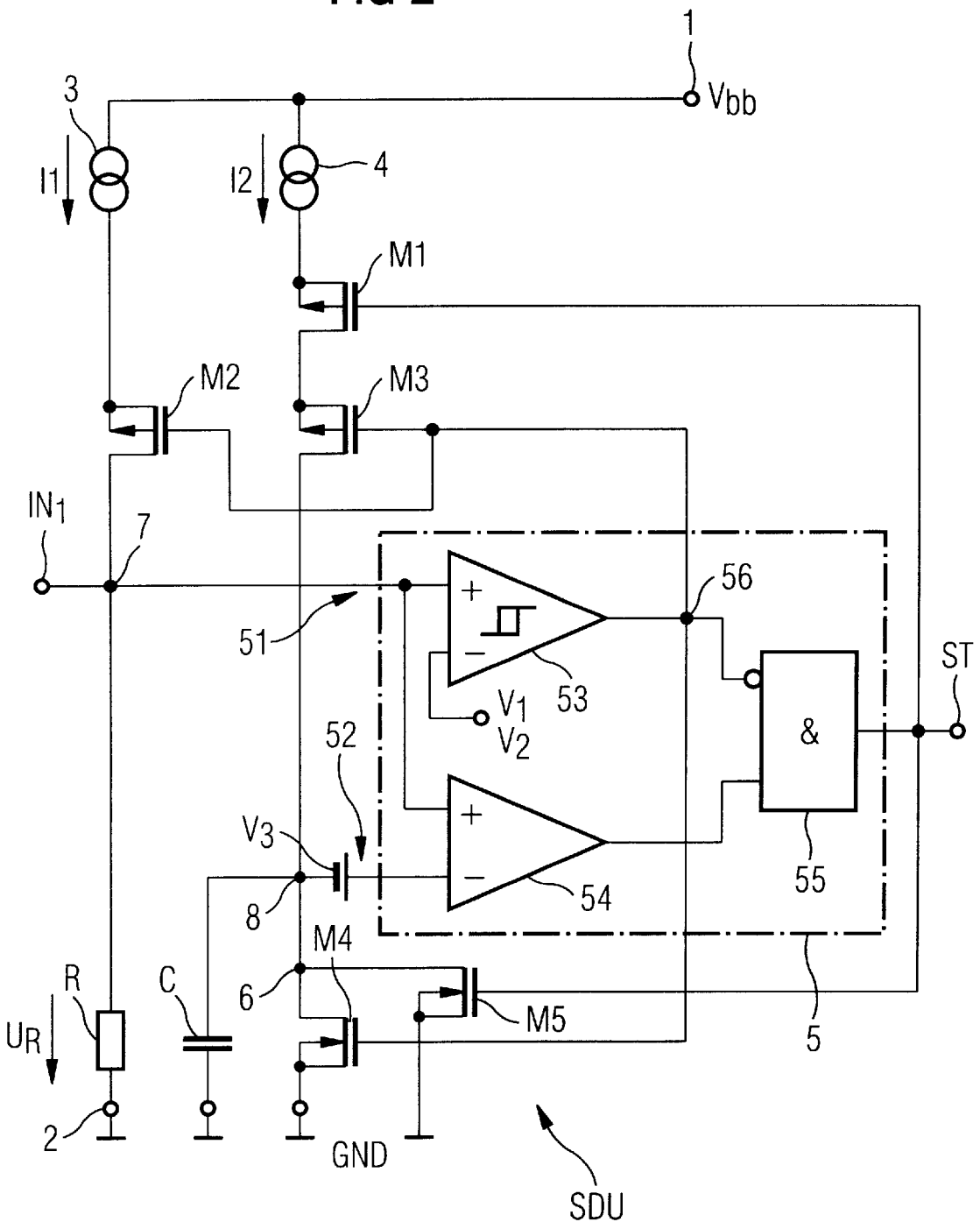
FIG. 2 the inventive circuit arrangement for detecting an interruption of the feedback line.

FIG. 2 shows the critical element of the inventive voltage regulator, namely the circuit arrangement SDU for detecting an interruption of the feedback line. The circuit arrangement SDU can be monolithically integrated on the integrated circuit IC together with the drive of the switch S1. The circuit arrangement SDU comprises an input $IN_1$ at which the output voltage $U_a$ is provided via the feedback line RL during normal operation. The input $IN_1$ of the circuit arrangement SDU is connected to a first input 51 of an evaluator 5.

Furthermore, a series circuit composed of a first current source 3, a semiconductor switch M2 as well as a resistor R is provided, this circuit is connected to a first supply potential terminal 1, at which the supply voltage Vbb or a voltage drive therefrom is usually provided, and to a second supply potential terminal 2 that represents the reference potential. The semiconductor switch M2 in the present example is implemented as p-channel enhancement MOSFET; however, a bipolar transistor or an arbitrary, controllable switch could also be utilized. The junction 7 between the resistor R and the drain terminal of the semiconductor switch M2 is connected to the input $IN_1$ of the circuit arrangement SDU.

The circuit arrangement SDU comprises another series circuit composed of a second current source 4, two semiconductor switches M1 and M3, whose load paths are interconnected with one another in series, as well as a capacitor C. This series circuit is in turn placed between the first one and the second supply potential terminal 2. The first supply potential terminal 1 is in contact with the first or, respectively, with the second current source 4.

Two further semiconductor switches M4 and M5 have their load path connected parallel to the charge storage C. The semiconductor switches M1 and M3 are implemented as p-channel enhancement MOSFETs, whereas the semiconductor switches M4 and M5 are n-channel enhancement MOSFETs. Arbitrary, controllable switches could also replace the semiconductor switches M1, M3, M4 and M5. The junction 8 between the capacitor C and the drain terminal of the semiconductor switch M3 is connected to a second input 52 of the evaluator 5 via a voltage source 6 that supplies the preset voltage V3.

The evaluator 5 comprises a first 53 and a second differential amplifier 54, whose positive inputs are connected together. These are in turn connected the first input 51 and, thus, with the input $IN_1$ of the circuit arrangement SDU. The first differential amplifier 53 is advantageously implemented with input hysteresis, i.e., two positive voltages of different size $V_1$ or, respectively, $V_2$ are applied to its negative input, where, e.g., two separate voltage sources $V_1$ or, respectively, $V_2$ could be provided for generation.

The second input 52 of the evaluator 5 is directly connected with the negative input of the second differential amplifier 54. The evaluator 5 further comprises a logic element 55 that is implemented as AND gate. This comprises an inverting input that is connected to the output of the first differential amplifier 53. The non-inverting, second input is connected to the output of the second differential amplifier 54. The output ST of the logic element 55 simultaneously represents the output ST of the circuit arrangement SDU. The output of the first differential amplifier 53 is also connected to the gate terminals of the semiconductor switches M2, M3 as well as M4. The output ST of the logic element 55, which assumes a low logical level in the normal case or, on the other hand, assumes a logical high level in case of fault, controls the gate of the semiconductor switches M1 and M5.

The current sources 3 and 4, the capacitor C as well as the voltage sources $V_1$, $V_2$ and $V_3$ are dimensioned such that the voltage at the input note $IN_1$ in the normal case, i.e., for a correctly connected, external capacitor LS, rises clearly more slowly than the voltage via the capacitor C. The following dimensioning to achieve this is:

$$V_2<V_3<I1*R<V_1<V_{IN1\ RATED}$$

This dimensioning results in the output of the second differential amplifier 54 supplying a logical L at the output in the normal case and, thus, the output ST also signals the correct functioning of the voltage regulator with a logical L. The determination as to whether an interruption of the feedback line RL is present is aborted in the normal case as soon as the voltage at the input $IN_1$ has risen above the reference voltage $V_1$. In this case, the first differential amplifier 53 changes from a logical L to a logical H so that the current sources 3 and 4 are shut off with the assistance of the semiconductor switches M2 and M3. The charge contained in the capacitor C is discharged due to the closing of the semiconductor switch M4.

The shut-off of the current sources 3 and 4 assures a low power consumption of the voltage regulator during normal operation.

When a fault occurs, the voltage at the input $IN_1$, due to the lack of the external charge storage LS, immediately changes to a voltage value $U_R$ that derives from the product of the current 11 and the resistor R. This results in the second differential amplifier 54 changing from a logical L to a logical H at its output, while the status of the first differential amplifier 53 remains unmodified at a logical L. This results in the output ST also changing from a logical L to a logical H, so that a fault is signaled.

When the circuit arrangement SDU is connected to the drive AN, then the voltage regulator can, for example, be immediately shut off. When the output ST has switched from a logical L to a logical H, then the charging event of the charged storage C is interrupted due to the opening of the power switch M1, and a potentially existing charge is in turn removed by closing M5. This condition is maintained until the interruption in the feedback line has been eliminated.

The first differential amplifier 53, which is advantageously implemented as Schmitt trigger, is implemented for suppressing transient noise signals having a great hysteresis, i.e.:

$$V_1-V_2>11*R.$$

Figure 3A:
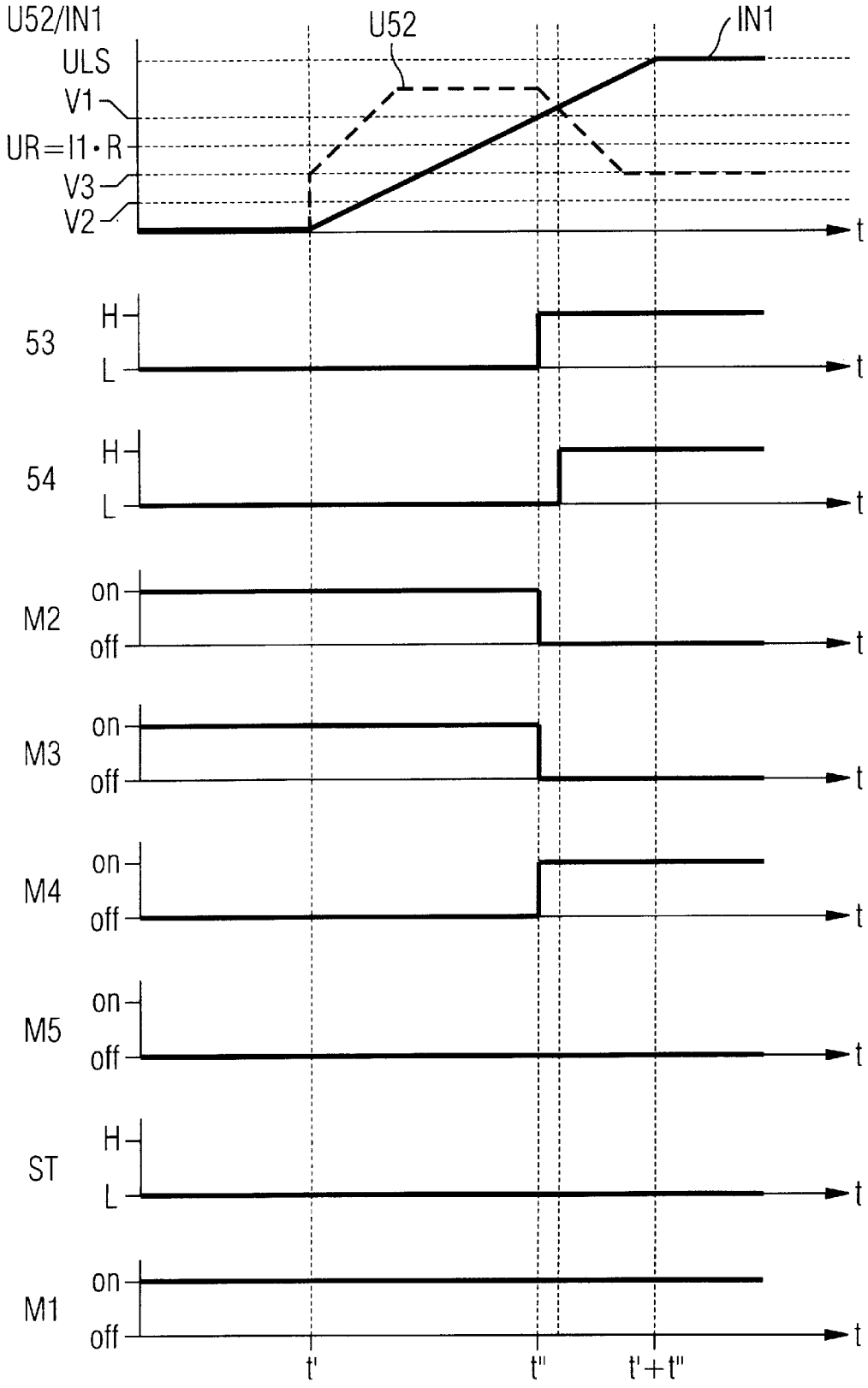
FIG. 3*a* the functioning of the circuit arrangement given runup of the voltage regulator as well as during an operation of the voltage regulator in normal operation.
Figure 3B:
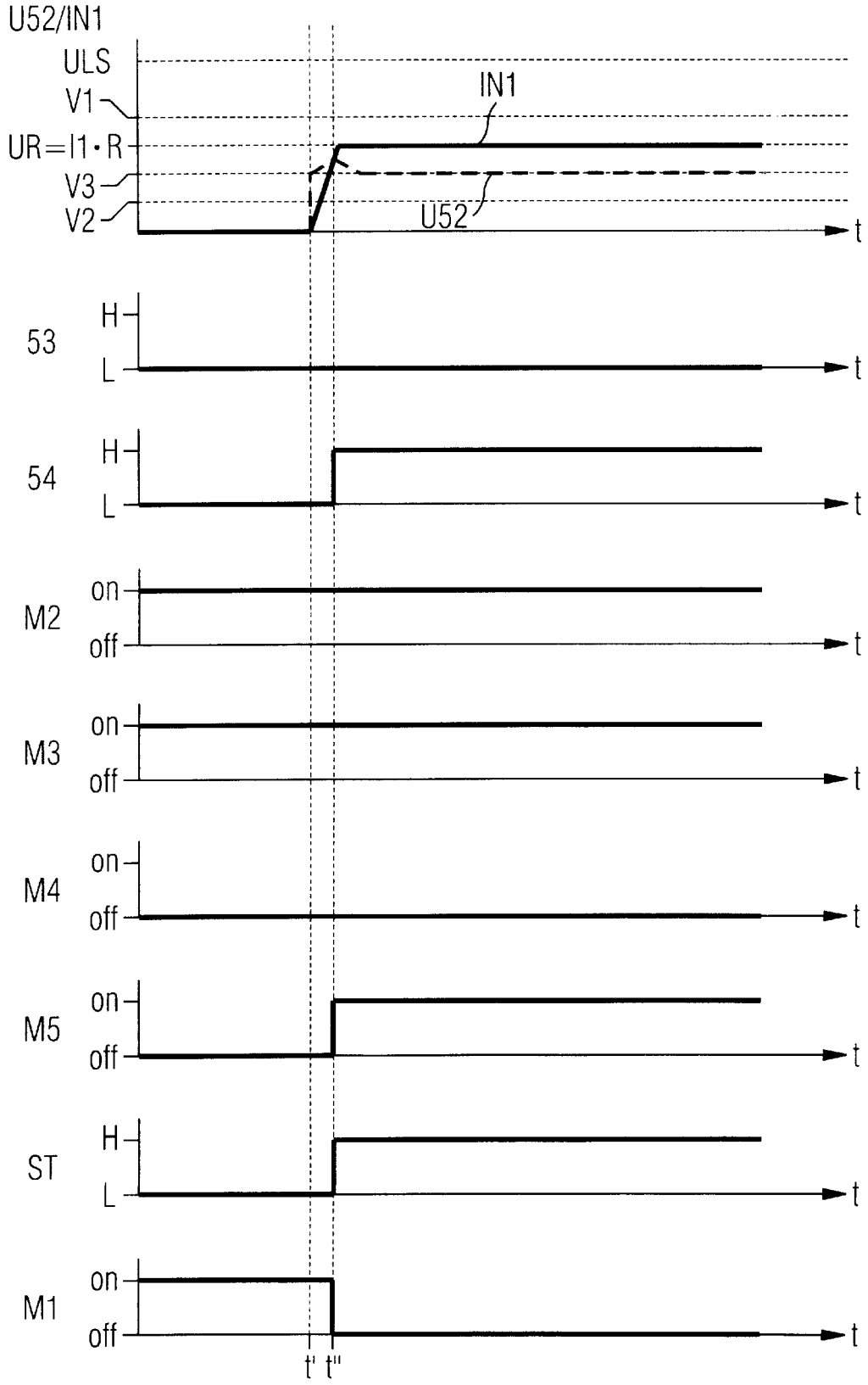
FIG. 3*b* the functioning of the circuit arrangement of the voltage regulator when a fault occurs upon runup.
Figure 3C:
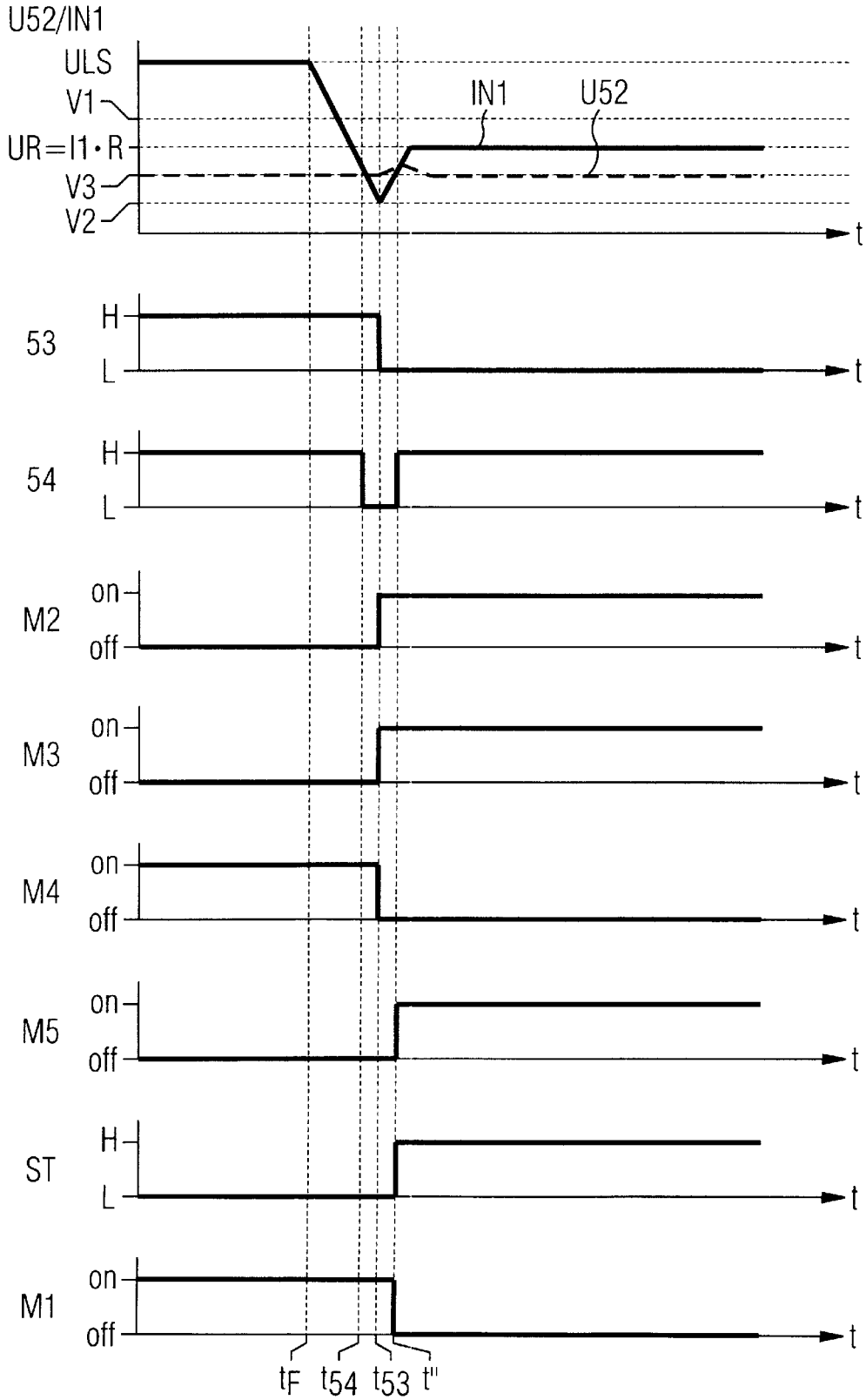
FIG. 3*c* the functioning of the circuit arrangement of the voltage regulator given the occurrence of a fault during the operation of the voltage regulator.

The functioning and the advantages of the inventive voltage regulator are explained in greater detail with reference to three different operating conditions. FIGS. 3*a* through 3*c* show the voltage values pending at the input $IN_1$, the logical signal values of the two differential amplifiers 53 and 54, and the switch conditions of the semiconductor switches M1 through M5 for this purpose.

FIG. 3*a* illustrates the functioning of the circuit arrangement SDU upon run-up of the voltage regulator as well as during an operation of the voltage regulator in normal operation. The voltage regulator is activated at time t'. Before reaching the time t', both differential amplifiers 53 and 54 exhibit a logical L at the output, resulting in the semiconductor switches M1 and M3 are closed (switched to conduct), whereas the semiconductor switches M4 and M5 are open (switched to inhibit). The logical L of the first differential amplifier 53 is inverted, so that a logical L is adjacent at the output ST of the logic element. This in turn results in activating the semiconductor switch M1.

At time t', the supply voltage $V_{bb}$ is applied to the first supply potential terminal 1. At this point, the run-up of the voltage regulator begins, i.e., the voltage at the input $IN_1$, which is connected via the feedback line RL to the output OUT of the voltage regulator, and the voltage value begins to continuously rise up to a value ULS. The voltage value ULS is predetermined by the control circuit. Up to the time t", the conditions of the individual components do not change.

After reaching the time t", the voltage at the input $IN_1$ exceeds the voltage value $V_1$, resulting in the output of the first differential amplifier 53 changing from a logical L to a logical H. This also results in the semiconductor switches M2 and M3 are switched open (i.e., non-conductive so that. further flow of current through the resistor R or, respectively, a further rise of the voltage at the junction 8 is suppressed). At the same time, the semiconductor switch M4 is switched closed (conductive), so that the charge stored in the charge capacitor C can flow off and a voltage of 0 V is established at the junction 8. M5 continues to remain in the inhibited condition.

Caused by the switch delay of M4, the output of the second differential amplifier 54 only changes briefly after the time t" from a logical L to a logical H. This is caused by the voltage curve (U52) at the second input 52 of the evaluator 5. The voltage curve 52 is also shown for clarification. At time t", the capacitor C begins the charge. Due to the opening of the semiconductor switch M4, U52 drops to a constant voltage value $V_3$. At the intersection of the voltage curves of U52 and $IN_1$, the output of the second differential amplifier then changes in value.

This behavior, however, has no influence on the signal at the output ST, which continues to remain at logical L. This signals a correct functioning of the voltage regulator. The voltage at the input $IN_1$ rises up to the time t'+t", rising to the value ULS. The charge storage LS has accepted its complete charge and the predetermined rated voltage is adjacent at the output OUT.

FIG. 3*b* shows the functioning of the inventive voltage regulator for a run-up when the feedback line is interrupted. The run-up begins at time t'. Up to time t', the differential amplifiers 53 and 54 respectively exhibit a logical L at their outputs. The semiconductor switches M2 and M3 are switched closed (conductive), whereas the semiconductor switches M4 and M5 are open (inhibiting). The status output ST likewise is at a logical L up to time t'. The semiconductor switch M1 is therefore switched conductive.

Beginning at t', the positive supply voltage $V_{bb}$ is present at the first supply potential terminal 1, i.e,. the run-up begins. Since the external charge storage LS is not connected to the input $IN_1$ due to the interruption of the feedback line RL, the current source 3 impresses a voltage $U_R$ in the resistor R via the closed switch M2, this voltage being present at the input $IN_1$ and, thus, at the first input 51 of the evaluator 5. This voltage is immediately available.

The voltage $U_R$ dropping off at the resistor is greater in terms of amount than the voltages $V_2$, which is adjacent at the negative input of the first differential amplifier 53, and greater than the three, which is adjacent at the negative input of the second differential amplifier 54. When the voltage at the input $IN_1$ exceeds the value U52 at time t", then the second differential amplifier 54 changes its signal at the output from L to a logical H. The output of the first differential amplifier 53 remains unmodified at a logical L. Since this becomes a logical H due to the inverting input in the logic element 55, the signal at the output ST changes from a logical L to a logical H and signals a fault. The result of this is that the semiconductor switch M1 is switched off and M5 is switched on thus discharging the charge storage C. The semiconductor switches M2 and M3 remain closed (conductive), whereas the semiconductor switch M4 continues to remain open (deactivated). The through-connect of M5 also has the advantage that the junction 8 lies at reference potential in defined fashion. A voltage rise at the junction 8 due to leakage currents through M1 is thus prevented.

It becomes clear from the specification that one advantage of the inventive circuit arrangement SDU is that a fault in the feedback line RL can be distinguished from a run-up of the voltage regulator.

The functioning of the circuit arrangement of the inventive voltage regulator for a fault occurrence during operation is explained in FIG. 3*c*. The error occurs at time $t_F$. Up to this time, the voltage ULS is present at the input $IN_1$. The two differential amplifiers 53 and 54 generate a logical H at their outputs. The semiconductor switches M2 and M3 are open (shut off), whereas the semiconductor switch M4 is switched closed (conductive). Due to the logical H adjacent at the outputs of the two differential amplifiers 53 and 54, the output ST exhibits a logical L. This results in the semiconductor switch M1 being turned on and M5 being turned off.

At time $t_F$, an interruption occurs in the feedback line RL. This results in the voltage at the input $IN_1$ beginning to drop from ULS to the value 0. When the voltage at the input $IN_1$ drops below the value $V_3$ at time t54, then the logical H at the output of the second differential amplifier 54 changes to a logical L. The voltage at the input $IN_1$ drops to the value $V_2$ by time t53 and the signal at the output of the first differential amplifier 53 changing to a logical L. At this time t53, the semiconductor switches M2 and M3 are switched closed (conductive), so that a current I1 can flow through the resistor R, which generates a voltage $U_R$ at the input $IN_1$. The voltage at the input $IN_1$ consequently begins to rise from a value $V_2$ to a vale $U_R$.

In practice, this results in an extremely steep gradient. For the sake of clarity, however, this is shown with a slight ramp in the drawing. At the same time, a current 12 can also flow through M1 and M3 and charge the capacitor C. The voltage rise thus connected to 8, however, takes place significantly more slowly than that at 7, so that the voltage at $IN_1$ very quickly exceeds the voltage U52. When the voltage adjacent at the input $IN_1$ exceeds the voltage value $V_3$, then the signal adjacent at the output of the second differential amplifier again changes to a logical H. The signal at the output ST of the logical element 55 consequently changes from a logical L to a logical 8 and signals a fault. At the same time, the current flow in the reference voltage branch is suppressed due to the opening of the semiconductor switch M1, and C is discharged due to the activation of M5. Only after the interruption in the feedback line has been eliminated, does the signal adjacent at the output ST again change to a logical L.

The above-described system is illustrative of the principles of the present invention. Numerous modifications and adaptions will be readily apparent to those skilled in this art without departing from the spirit and scope of the present invention.

What is claimed is:

1. A voltage regulator system comprising:

an integrated circuit, comprising:

an input;

a drive for monitoring and regulating an output voltage to a predetermined first voltage value; and a circuit arrangement for detecting an interruption of a feedback line; and a voltage regulator, comprising:

an input that is connected to a first supply voltage;

an output at which said output voltage is supplied during normal operation via said feedback line to said input of said integrated circuit, and at which said output voltage is switched from said predetermined first voltage value to a predetermined second voltage value when said interruption occurs.

2. A voltage regulator system according to claim 1, further comprising:

a ground-related first charge storage to which said output of said voltage regulator is connected, and wherein output voltage dropping off at said charge storage is supplied to said drive and to said circuit arrangement for detecting said interruption of said feedback line.

3. A voltage regulator system according to claim 1, wherein said circuit arrangement has an output connected to the said drive.

4. A voltage regulator system according to claim 1, wherein said circuit arrangement further comprises:

an evaluator having an input that is tied to said input of said integrated circuit to which said interruption is applied, wherein when said interruption occurs, a second smaller predetermined voltage value that is smaller than an output voltage is present at said input of said integrated circuit, said output voltage value being supplied together with a reference voltage value, generated within a third time span beginning with the occurrence of said interruption;

said evaluator generating a signal at said output of said circuit arrangement to said drive.

5. A voltage regulator system according to claim 4, wherein said circuit arrangement further comprises a first series circuit comprising:

a first current source;

a first switch mechanism; and a resistor;

wherein said first series circuit is provided between supply potential terminals for generating said second voltage value; and wherein said circuit arrangement further comprises a junction which connects said resistor, said first switch mechanism, said input of said integrated circuit, and said input of said evaluator.

6. A voltage regulator system according to claim 4, wherein said circuit arrangement further comprises a second series circuit comprising:

a second current source;

a second switch mechanism; and a second charge storage;

wherein said second series circuit is provided between supply potential terminals for generating a reference voltage value; and wherein said circuit arrangement further comprises a second junction which connects said second charge storage, said second switch mechanism, and a second input of said evaluator;

said circuit arrangement further comprising a third semiconductor switch mechanism whose load path is connected parallel to said second charge storage.

7. A voltage regulator system according to claim 6, wherein said second switch mechanism comprises two semiconductor switches serially interconnected with its load path.

8. A voltage regulator system according to claim 4, wherein said evaluator further comprises:

a first differential amplifier having a positive input and a negative input, and an output, wherein said negative input is connected to a voltage supply that provides two voltage values;

a second differential amplifier having a positive input and a negative input, and an output, wherein said negative input is connected to said second junction; and a logic element having a first input, a second input, and an output which is connected to said output of said circuit arrangement;

wherein said circuit arrangement further comprising a third junction connecting said positive input of said first differential amplifier, said positive input of said second differential amplifier, and said input of said integrated circuit, thereby forming a first input of said evaluator;

wherein said output of said first differential amplifier is connected to said first input of said logic element and drives said first switch mechanism and said second switch mechanism to be conductive, and said third switch mechanism to be nonconductive when a fault occurs; and wherein said output of said second differential amplifier is connected to said second input of said logic element.

9. A voltage regulator system according to claim 8, wherein said output of said logic element switches said second switch mechanism to be non-conductive, and switches an element of said third switch mechanism to be conductive in case of a fault.

10. A voltage regulator system according to claim 8, wherein said logic element is an AND gate, and wherein said first input of said logic element is inverting.

11. A voltage regulator system according to claim 6, wherein:

said first charge storage is a capacitor; and said second charge storage is a capacitor having a smaller capacitance than said first charge storage capacitor.

12. A voltage regulator system according to claim 8, wherein said circuit arrangement further comprises a preset voltage source connected between said negative input of said second differential amplifier and said second charge storage.

13. A voltage regulator system according to claim 8, wherein said circuit arrangement further comprises an internal signal that switches said circuit arrangement into a standby mode.

14. A voltage regulator system according to claim 8, wherein said first differential amplifier is implemented as a Schmitt trigger.

* * * * *